US005811023A

United States Patent [19]

Hohenbichler

[11] Patent Number: 5,811,023

[45] Date of Patent: Sep. 22, 1998

[54] MOLTEN METAL CONTINUOUS CASTING PROCESS

[75] Inventor: Gerald Hohenbichler, Enns, Austria

[73] Assignee: Voest-Alpine Industrieanlagenbau GmbH, Linz, Austria

[21] Appl. No.: 686,522

[22] Filed: Jul. 26, 1996

[30] Foreign Application Priority Data

Jul. 27, 1995 [AT] Austria ..... 1286/95

[51] Int. Cl.[6] ..... B22D 35/00

[52] U.S. Cl. ..... 222/606; 266/236

[58] Field of Search ..... 222/591, 606, 222/607; 266/236, 44, 94, 210, 45

[56] References Cited

U.S. PATENT DOCUMENTS

| | | | |
|---|---|---|---|
| 2,929,704 | 3/1960 | Harders | 266/210 |
| 3,592,456 | 7/1971 | Miklos | 266/208 |
| 3,776,534 | 12/1973 | Cashdollar, Sr. | 266/44 |
| 3,888,294 | 6/1975 | Fastner et al. | 164/66 |
| 3,991,815 | 11/1976 | Fastner et al. | 164/66 |
| 4,787,438 | 11/1988 | Flemming et al. | 164/453 |
| 5,456,307 | 10/1995 | Mouri | 164/466 |

FOREIGN PATENT DOCUMENTS

| | | | |
|---|---|---|---|
| 0114309 | 2/1987 | European Pat. Off. . | |
| 405169211 | 7/1993 | Japan | 222/606 |

*Primary Examiner*—Scott Kastler
*Attorney, Agent, or Firm*—Greenblum & Bernstein, P.L.C.

[57] ABSTRACT

An apparatus and method related to a start-up phase for continuous casting of a molten metal. The molten metal flows into a continuous casting mold through at least one lateral opening of a submerged nozzle and through at least one bottom opening of the submerged nozzle. The at least one lateral opening may be directed toward a respective at least one wall of the continuous casting mold and the at least one bottom opening may be directed in a casting direction. During a start-up phase of the continuous casting process, a higher ratio of flow rates of molten metal through the at least one lateral opening to the molten metal flowing through the at least one bottom opening may be maintained than the ratio of the flow rates during a subsequent normal operation phase of the submerged nozzle.

16 Claims, 1 Drawing Sheet

MOLTEN METAL CONTINUOUS CASTING PROCESS

CROSS REFERENCE OF RELATED APPLICATIONS

The present invention is based upon Austrian Patent Application No. A 1286/95 filed Jul. 27, 1995, the disclosure of which is incorporated by reference herein in its entirety.

BACKGROUND OF THE INVENTION

1. Field of the Invention

The present invention is directed to an apparatus and method for the continuous casting of molten metal and, in particular, molten steel. The present invention may include the molten metal flowing into a continuous casting mold for casting thin slabs. The molten metal may flow through a submerged nozzle (casting tube), the nozzle including at least one lateral opening directed to a side wall of the continuous casting mold and at least one bottom opening directed in a casting direction.

2. Discussion of Background Information

The process of continuously casting steel with a submerged nozzle has been disclosed in, e.g., U.S. Pat. Nos. 3,888,294 and 3,991,815, the disclosures of which are incorporated by reference herein in their entireties. Submerged nozzles with lateral openings and at least one bottom opening have generally been utilized for the production of thin metal slabs and for enabling high casting rates. However, the cross-section of these slabs is small.

In the conventional continuous casting process utilizing a submerged nozzle, the process may be divided into a start-up phase and a normal operating phase. An exemplary discussion of the phases of the continuous casting process may be found, for example, in U.S. Pat. No. 4,787,438, the disclosure of which is incorporated by reference herein in its entirety. During the start-up phase, the casting rates must increase from zero to a nominal (set) rate corresponding to the normal operating phase. In general, the start-up phase may last for approximately one to two minutes. Further, difficulties similar to those occurring during the start-up phase of the casting process also occur following a replacement or exchange of the submerged nozzle. Thus, during the start-up phase, the submerged nozzle does not operate within the set range of casting speed or the set rate for which it is designed.

Consequently, molten metal flows which occur during the start-up phase are completely different from the flow occurring during normal operation. Thus, the amount of the molten metal directed toward the casting level during the start-up phase is much less than desired, which results in a danger of top crust or bridge formation. This danger is much greater during start-up than during continuous casting in the normal operating phase.

Another drawback occurs during the start of casting in a conventional continuous casting process utilizing a submerged nozzle with a bottom opening to enable a vertically directed downward stream of molten metal immediately toward a dummy bar head. The dummy bar head is utilized for closing the bottom end of a permanent continuous casting mold and is covered with cooling chips to avoid forming a welded joint between the strand and the dummy bar head. The downwardly directed casting stream washes the cooling chips away from the dummy bar head which can result in difficulty separating the cast strand from the dummy bar head. Additional discussion regarding the dummy bar (starter bar) head may be found in U.S. Pat. No. 5,456,307 and EP 0,114,309, the disclosure of each document is incorporated by reference herein in its entirety.

Further drawbacks in the conventional continuous casting process arise during the exchange of the tundish (i.e., the vessel) which contains the molten metal and from where the molten metal flows through the submerged nozzle. The tundish exchange is generally made either to change the quality of the molten metal or to effect repair work.

SUMMARY OF THE INVENTION

According to one aspect of the present invention, during the start-up phase, the flow rate of the molten metal flows through the lateral opening is significantly greater than the flow rate through the bottom opening. The flow rate ratio of the lateral opening to the bottom opening maintained during the start-up phase of the submerged nozzle is greater than the flow rate ratio during the normal operation phase.

According to a particular feature of the present invention, during the start-up phase, the molten metal flows through the bottom opening of the submerged nozzle at a reduced flow rate. The reduced flow rate may be approximately 15% of the total molten metal flow during the normal operating phase of the submerged nozzle.

According to another feature of the present invention, the flow of the molten metal through the bottom opening of the submerged nozzle may be temporarily disabled during the start-up phase.

According to another feature of the present invention, the submerged nozzle, for the continuous casting of a molten metal and for continuous casting with the molten metal flowing into the continuous casting mold, may include at least one lateral opening directed toward one side wall of the continuous casting mold and at least one bottom opening directed in a casting direction. The submerged nozzle may be provided with a cover that at least partially covers the bottom opening at the beginning of the start-up phase and may be removed by the molten metal.

According to another feature of the present invention, the cover may at least partially cover the bottom opening and may be removed by the molten metal by removal, evaporation, or combustion, etc. Further, the cover may be formed of a material which melts under the high temperature of the molten metal.

According to yet another feature of the present invention, the flow rate of the downward stream during start-up may be significantly reduced. Further, the cover may be perforated like a grid.

According to another feature of the present invention, the cover may be made of a metal in which the quality may be the same or similar to that of the molten metal, e.g., steel.

According to another feature of the present invention, the cover may be secured in position by a nose supported by the at least one opening.

According to a further feature of the present invention, the thickness of the cover positioned over the bottom opening may be rated in accordance with a period of time during which a reduced stream of the molten metal may be desired to flow through the bottom opening.

Because the submerged nozzle may be hot during the start-up phase and the cover may be cold at the beginning of the start-up phase, i.e., the temperature of the cover is considerably lower than that of the submerged nozzle, the melting period of the cover during the start-up phase takes longer.

The present invention may be directed to a nozzle for regulating a flow rate of molten metal into a continuous casting mold. The nozzle may include a tubular member for directing the molten metal into the continuous casting mold. The tubular member may include a first and second end, the first end coupled to a molten metal source and the second end, which may include at least one lateral opening and at least one bottom opening, which enable flow of molten metal into the continuous casting mold. The nozzle may also include a cover member at least partially covering the at least one bottom opening at a beginning of a start-up phase of a continuous casting process.

According to another feature of the present amendment, the cover member may regulate a flow rate of the molten metal through the at least one bottom opening with respect to the at least one lateral opening such that a lateral opening-to-bottom opening flow rate during a start-up phase of the continuous casting process is greater than a lateral opening-to-bottom opening flow rate during a normal operating phase of the continuous casting process.

According to another feature of the present invention, the cover member may be removed prior to beginning a normal operating phase of the continuous casting process.

According to yet another feature of the present invention, the start-up phase may last between approximately one and two minutes.

According to a further feature of the present invention, the cover may include at least one projection for fixing the cover over the bottom opening.

According to yet another feature of the present invention, the at least one projection may be coupled to the at least one lateral opening.

According to another feature of the present invention, the at least one projection may be coupled to the at least one bottom opening.

According to another aspect of the present invention, the invention may be directed to a method for regulating a flow rate of molten metal into a continuous casting mold. The method may include covering an output portion of a nozzle with a cover. The method may also include directing the molten metal into the continuous casting mold through at least one lateral opening in the nozzle during a start-up phase of a continuous casting process at a first predetermined flow rate and directing the molten metal into the continuous casting mold toward the covered portion, such that the molten metal through the covered portion flows at a flow rate that increases during the start-up phase of the continuous casting process.

According to another feature of the present invention, the method may also include continuously removing portions of the cover during the start-up phase, such that the cover is completely removed when a normal operating phase of the continuous casting process begins.

According to another feature of the present invention, the step of continuously removing portions of the cover may include one of melting, consumption, combustion, and removal.

When the molten metal quality is changed by exchange of tundish, without interrupting the continuous casting operation, the method according to the present invention may lead to the production of a short strand section including different metal grades. Additional advantages of the method according to the present invention may be realized because when the submerged nozzle or the tundish is changed, the mold level remains hot and the newly applied casting powder melts quickly.

It is an object of the present invention to avoid the above-mentioned drawbacks and difficulties by utilizing a process that averts the danger of top crust of bridge formation by preventing the cooling chips from being washed away from the dummy bar head during start-up. According to the present invention, immediately after start-up, the normal operation phase follows without delays and/or variations from the conventional process.

BRIEF DESCRIPTION OF THE DRAWINGS

The present invention is further described in the detailed description which follows, in reference to the noted plurality of drawings by way of non-limiting examples of preferred embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for the fundamental understanding of the invention, the description taken with the drawings making apparent to those skilled in the art how the several forms of the invention may be embodied in practice.

Figure 1:
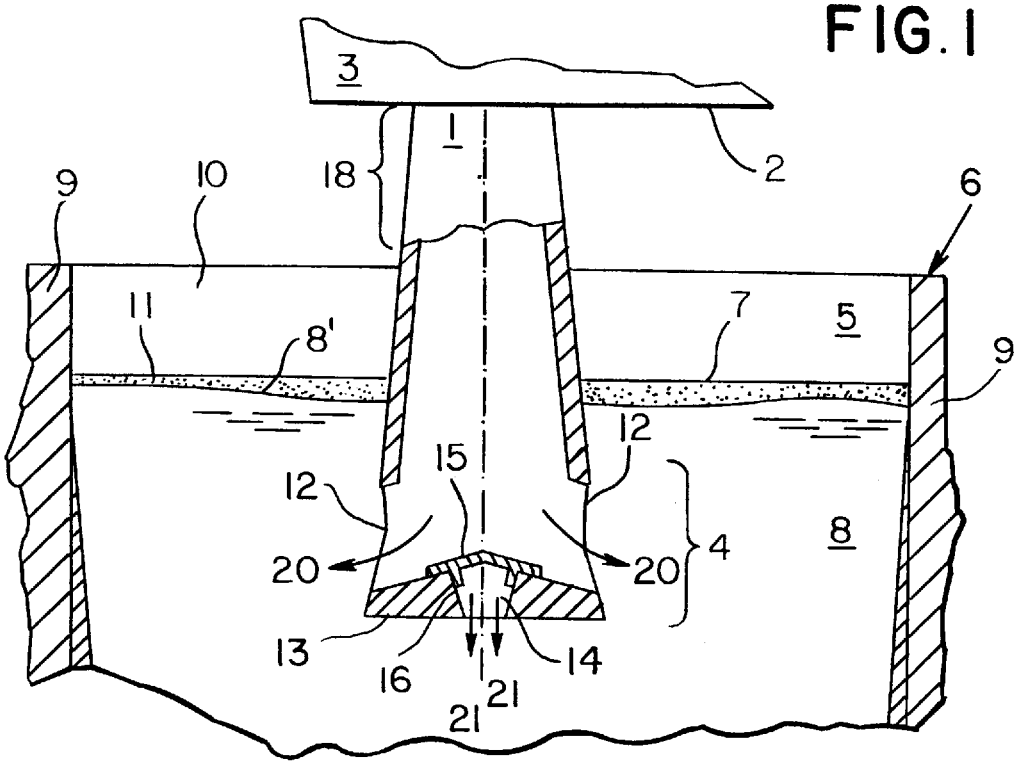
FIG. 1 shows a vertical section of a submerged nozzle inserted in a continuous casting mold during a start-up phase of the submerged nozzle.

As shown in FIG. 1, a first end 18 of a submerged nozzle (casting tube) 1 may be inserted into a bottom 2 of an intermediate vessel (tundish) 3 and a second end 4 may be inserted into a hollow space 5 of a permanent continuous casting mold 6 designed for continuous casting of, e.g., thin slabs or slabs of other thickness. The molten metal may be transported from the tundish 3 to the continuous casting mold 6 through nozzle 1. As is conventional in certain continuous casting processes, second end 4 may be submerged below the surface 7 of the liquid molten metal 8. For example, continuous casting mold 6 may be rectangularly shaped with a pair of opposing narrow side walls 9 and a pair of opposing long side walls 10, with a cross-section of, e.g., approximately 70 mm×1500 mm, however other dimensional arrangements are within the purview of the ordinarily skilled artisan in accordance with the present invention. The molten metal surface 8', i.e., the casting mold level, may be covered with casting powder 11.

Second end 4 of nozzle 1 may be provided with two lateral/side openings 12. Each of the two openings 12 may be directed against a respective one of the narrow sides 9. Streams of molten metal 8 indicated, e.g., by arrows 20, may emerge through side openings 12 toward narrow sides 9. At second end 4, nozzle 1 may also be equipped with a bottom member 13. Bottom member 13 may include an opening 14 through which streams molten metal 8, indicated, e.g., by arrows 21, may emerge approximately vertically downwards (i.e., in a casting direction).

As discussed above, the conventional continuous casting process utilizing a submerged nozzle may be divided into a start-up phase and a normal operating phase. During the start-up phase, the casting rates must increase from zero to a nominal (set) rate corresponding to the normal operating phase. In general, the start-up phase may last, e.g., approximately one to two minutes. According to the present invention, the streams of molten metal 8 entering continuous casting mold 6 through bottom opening 14 may, however, be restricted during the start-up phase. For example, the quantity of molten metal flowing through the bottom opening 14 during the start-up phase of the continuous casting process may 15% of the molten metal flowing through the same bottom opening 14 during the normal operating phase.

Figure 2:
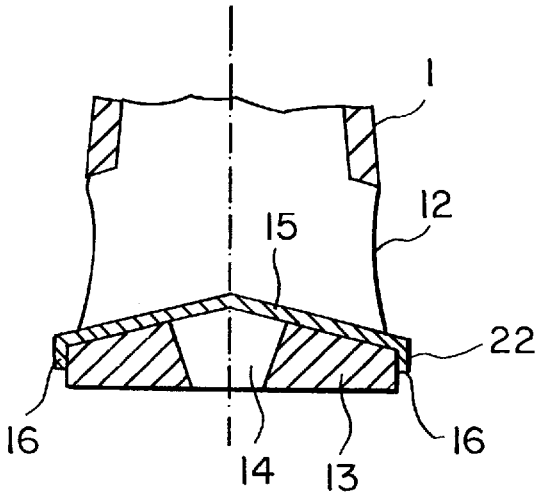
FIG. 2 shows the submerged nozzle including an alternative cover.

The molten metal stream through bottom opening 14 may be restricted by a removable cover 15 during the start-up phase. Cover 15 may be made of, e.g., metal, steel or other suitable material, and may be designed as a cap. Cover 15, as shown in FIG. 1, may be centered over bottom opening 14 by projections 16 extending from cover 15. Projections 16 may be, e.g., noses or ridges, which frictionally fit within bottom opening 14 to ensure a proper, anti-skid seat for cover 15 over bottom opening 14. Alternatively, the projections 16 of cover 15 may be provided with an outer rim 22 which may be coupled to the exterior of nozzle 1, as shown in FIG. 2. The outer rim 22 may be coupled to the exterior of nozzle 1 by frictionally coupling, e.g., by bending the rim inwardly.

For example, in a continuous casting process for casting molten steel, cover 15 may be made of, e.g., a steel plate which may be, e.g., approximately 3 to 4 mm thick. Under conventional operation, such a steel plate will melt within, e.g., approximately 1 to 1.5 minutes. This melting time of approximately 1 to 1.5 minutes corresponds to the general time required for completing the start-up phase and beginning the normal operating phase. After the steel plate is removed, e.g., by consumption, combustion, removal, melting, or other suitable means, bottom opening 14 is no longer covered and the flow of the molten metal stream through opening 14 is no longer restricted. As is apparent to the ordinarily skilled artisan, the thickness of the steel plate may be dimensioned in accordance with a desired period of time in which to consume (melt, combust) the steel plate. Thus, by properly dimensioning cover 15, the artisan may control the extent of time that molten metal flow is restricted through bottom opening 14.

When the consumption, combustion, melting or removal of cover 15 may take longer than desired by the user, the consumption, combustion, melting or removal time may be reduced, e.g., by utilizing a cover 15 of reduced thickness. Another alternative to adjust consumption or removal time of cover 15 is to insert cover 15, in a cold condition, into nozzle 1 shortly before the start-up phase of casting, but after preheating nozzle 1.

The thickness of cover 15 may also be smaller than approximately 3 mm. This may be particularly advantageous to prevent washing away the cooling chips surrounding the dummy bar head during the start-up phase of casting. A bottom end (not shown) of the continuous casting mold 6 may be closed by the head of a dummy bar. The head may be sealed toward side walls 9 and 10 by any suitable sealing devices and may be covered with cooling chips which assist in avoiding fusing the cast strand with an external surface of the dummy bar.

Cover 15 may be made from, e.g., a same or similar quality metal as the molten metal 8 to be cast. Thus, it is not necessary that cover 15 be completely molten and/or that parts of cover 15 act as a crystallization nucleus.

Figure 3:
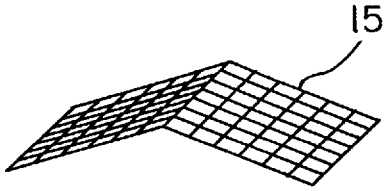
FIG. 3 shows another alternative cover for use with the submerged nozzle.

In a further alternative embodiment, cover 15 may be made of grid type structure as shown in FIG. 3. In this embodiment, the flow stream of molten metal is reduced, but not inhibited, through bottom opening 14 during the initial start-up phase of the casting process.

Accordingly, cover 15 may be utilized to greatly reduce the risk of top crust and bridge formation. Further, use of cover 15 may result in a reduced break out risk during the starting up phase of the continuous casting process or upon restarting casting after exchanging a submerged nozzle 1 or changing a tundish. Cover 15 also greatly reduces the danger of washing off and exposing the dummy bar head at the start-up phase of casting, i.e., the risk of breakouts may be considerably reduced.

It is noted that the foregoing examples have been provided merely for the purpose of explanation and are in no way to be construed as limiting of the present invention. While the invention has been described with reference to a preferred embodiment, it is understood that the words which have been used herein are words of description and illustration, rather than words of limitation. Changes may be made, within the purview of the appended claims, as presently stated and as amended, without departing from the scope and spirit of the invention in its aspects. The cover, as disclosed herein, may be made of, e.g., metal, steel, or other suitable material. The cover may also be formed as a solid sheet, a grid, a perforated sheet, a holed sheet, etc., which may be employed by the ordinarily skilled artisan to regulate the flow of the molten metal stream through the bottom opening during the start-up phase.

Although the invention has been described herein with reference to particular materials and embodiments, the invention is not intended to be limited to the particulars disclosed herein; rather, the invention extends to all functionally equivalent structures, methods and uses, such as are within the scope of the appended claims. For example, the present invention may also be utilized during a start-up phase, including a start-up phase following, e.g., a replacement of nozzles or tundishes.

What is claimed:

1. A nozzle for transmitting molten metal into a continuous casting mold for metal casting, said nozzle comprising:

at least one lateral opening directed toward a side wall of the continuous casting mold;

at least one bottom opening directed in a casting direction; and a cover at least partially covering the at least one bottom opening at a beginning of a start-up phase.

2. The nozzle according to claim 1, said cover comprising a material meltable by the molten metal.

3. The nozzle according to claim 2, said cover comprising a metal of one of a same and a similar quality as the molten metal.

4. The nozzle according to claim 1, said cover made from steel.

5. A nozzle for transmitting molten metal into a continuous casting mold for metal casting, said nozzle comprising:

at least one lateral opening directed toward a side wall of the continuous casting mold;

at least one bottom opening directed in a casting direction; and a cover at least partially covering the at least one bottom opening at a beginning of a start-up phase, said cover comprising a plurality of openings.

6. The nozzle according to claim 5, said cover comprising a grid material.

7. The nozzle according to claim 1, said cover comprising at least one securing member for fixing said cover in place.

8. The nozzle according to claim 7, said securing member comprising a nose supported by at least one of an edge defining said at least one lateral opening and an edge defining said at least one bottom opening.

9. The nozzle according to claim 1, said cover comprising a thickness, said thickness determined by a desired period of time for which a lower rate of molten metal flows through said at least one bottom opening.

10. The nozzle according to claim 9, said cover substantially completely covering said at least one bottom opening.

11. A nozzle for regulating a flow rate of molten metal into a continuous casting mold, said nozzle comprising:

a tubular member for directing the molten metal into the continuous casting mold;

said tubular member including a first and second end, said first end coupled to a molten metal source, said second end enabling the molten metal to flow into the continuous casting mold;

said second end including at least one lateral opening and at least one bottom opening; and a cover member at least partially covering said at least one bottom opening at a beginning of a start-up phase of a continuous casting process.

12. The nozzle according to claim 11, said cover member regulating a flow rate of the molten metal through said at least one bottom opening with respect to said at least one lateral opening such that a lateral opening-to-bottom opening flow rate during a start-up phase of the continuous casting process is greater than a lateral opening-to-bottom opening flow rate during a normal operating phase of the continuous casting process.

13. The nozzle according to claim 11, said cover member being removable wherein said cover member is removed prior to beginning a normal operating phase of the continuous casting process.

14. The nozzle according to claim 11, said cover comprising at least one projection for fixing said cover over said bottom opening.

15. The nozzle according to claim 14, said at least one projection coupled to said at least one lateral opening.

16. The nozzle according to claim 14, said at least one projection coupled to said at least one bottom opening.

* * * * *